US010981721B2

(12) United States Patent
Ren et al.

(10) Patent No.: US 10,981,721 B2
(45) Date of Patent: Apr. 20, 2021

(54) STORAGE DEVICE AND STORAGE BAG

(71) Applicant: BOE TECHNOLOGY GROUP CO., LTD., Beijing (CN)

(72) Inventors: Yan Ren, Beijing (CN); Zifeng Wang, Beijing (CN); Lei Cao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 369 days.

(21) Appl. No.: 15/780,869

(22) PCT Filed: Nov. 14, 2017

(86) PCT No.: PCT/CN2017/110791
§ 371 (c)(1),
(2) Date: Jun. 1, 2018

(87) PCT Pub. No.: WO2018/192212
PCT Pub. Date: Oct. 25, 2018

(65) Prior Publication Data

US 2020/0255218 A1 Aug. 13, 2020

(30) Foreign Application Priority Data

Apr. 21, 2017 (CN) ..... 201720425968.8

(51) Int. Cl.
*B65F 1/14* (2006.01)
*B65F 1/06* (2006.01)
*B65F 1/16* (2006.01)

(52) U.S. Cl.
CPC ..... *B65F 1/1415* (2013.01); *B65F 1/062* (2013.01); *B65F 1/1405* (2013.01); *B65F 1/16* (2013.01);

(Continued)

(58) Field of Classification Search
CPC combination set(s) only.
See application file for complete search history.

(56) References Cited

U.S. PATENT DOCUMENTS 3,253,812 A * 5/1966 Okazaki ..... B65B 67/12 248/97
3,707,271 A * 12/1972 Sanchez ..... B65B 7/02 248/101

(Continued)

FOREIGN PATENT DOCUMENTS

CN 201604956 U 10/2010
CN 202912220 U 5/2013

(Continued)

OTHER PUBLICATIONS

International Search Report of PCT/CN2017/110791 in Chinese, dated Jan. 26, 2018 with English translation.

(Continued)

*Primary Examiner* — Monica E Millner
(74) *Attorney, Agent, or Firm* — Collard & Roe, P.C.

(57) ABSTRACT

A storage device and a storage bag are provided. The storage device includes: a barrel-shaped body, including a bottom board and a side wall connected with the bottom board; a storage bag convey member, disposed an outer side of the side wall, and configured to convey a storage bag to a side edge of the side wall away from the bottom board; a first driving part, including a rotation part and a rocker arm, the rotation part being disposed on the bottom board, an end of the rocker arm being connected with the rotation part, another end of the rocker arm extending to a side of the side wall away from the bottom board, and the rocker arm being configured to rotate along the side wall under driven of the rotation part.

18 Claims, 6 Drawing Sheets

(52) U.S. Cl.
CPC ... *B65F 2210/162* (2013.01); *B65F 2210/168* (2013.01)

(56) References Cited

U.S. PATENT DOCUMENTS

| | | | | |
|---|---|---|---|---|
| 3,817,448 | A * | 6/1974 | Schneider | B65B 51/00 232/43.2 |
| 6,024,238 | A * | 2/2000 | Jaros | B65F 1/163 16/84 |
| 6,370,847 | B1 * | 4/2002 | Jensen | B65B 9/15 53/370 |
| 6,502,367 | B1 * | 1/2003 | Sterner | B65B 51/00 53/138.3 |
| 7,395,990 | B1 * | 7/2008 | Stevens | B65F 1/062 248/97 |
| 7,543,716 | B2 * | 6/2009 | Lin | B65F 1/163 220/495.11 |
| 8,317,055 | B2 * | 11/2012 | Zawrotny | B65F 1/062 220/495.07 |
| 8,984,847 | B1 * | 3/2015 | Nguyen | B65F 1/062 53/567 |
| 9,428,335 | B2 * | 8/2016 | Hammond | B65F 1/062 |
| 9,718,614 | B2 * | 8/2017 | Chomik | B65B 67/1277 |
| 9,751,692 | B2 * | 9/2017 | Yang | B65F 1/1646 |
| 10,618,728 | B2 * | 4/2020 | Chomik | B65F 1/1426 |
| 10,723,549 | B2 * | 7/2020 | Yang | B65F 1/163 |
| 2004/0206760 | A1 * | 10/2004 | Gagnebin | B65F 1/08 220/495.04 |
| 2005/0121868 | A1 * | 6/2005 | Hartman | B62B 1/12 280/47.26 |
| 2006/0010837 | A1 * | 1/2006 | Jurus | B65F 1/062 53/436 |
| 2006/0159815 | A1 * | 7/2006 | Crook | B65D 83/0005 426/394 |
| 2006/0175336 | A1 * | 8/2006 | Wang | B65F 1/163 220/495.04 |
| 2007/0012699 | A1 * | 1/2007 | Yang | B65F 1/163 220/264 |
| 2007/0266637 | A1 * | 11/2007 | McGowan | B65F 1/1638 49/349 |
| 2010/0294769 | A1 * | 11/2010 | Lee | B65F 1/163 220/263 |
| 2011/0220648 | A1 * | 9/2011 | Yang | B65F 1/1638 220/211 |
| 2014/0246434 | A1 * | 9/2014 | Yang | B65F 1/1623 220/264 |
| 2016/0304268 | A1 * | 10/2016 | Schneider | B65D 25/56 |

FOREIGN PATENT DOCUMENTS

| | | | |
|---|---|---|---|
| CN | 203544832 | U | 4/2014 |
| CN | 204137688 | U | 2/2015 |
| CN | 204351250 | U | 5/2015 |
| CN | 104709639 | A | 6/2015 |
| CN | 106103299 | A | 11/2016 |
| JP | H11-79305 | A | 3/1999 |

OTHER PUBLICATIONS

Notice of Transmittal of the International Search Report of PCT/CN2017/110791 in Chinese, dated Jan. 26, 2018.

Written Opinion of the International Searching Authority of PCT/CN2017/110791 in Chinese, dated Jan. 26, 2018 with English translation.

* cited by examiner

STORAGE DEVICE AND STORAGE BAG

CROSS REFERENCE TO RELATED APPLICATIONS

This application is the National Stage of PCT/CN2017/110791 filed on Nov. 14, 2017, which claims priority under 35 U.S.C. § 119 of Chinese Application No. 201720425968.8 filed on Apr. 21, 2017, the disclosure of which is incorporated by reference.

TECHNICAL FIELD

At least one embodiment of the present disclosure relates to a storage device and a storage bag.

BACKGROUND

Currently, a household garbage requires people to manually place garbage bags. Upon a garbage bag being full, people need to manually remove the garbage bag, so that the user experience is poor. On the other hand, the waste in the garbage is mostly food waste or toilet waste, and a density of the waste in the garbage bag is low, resulting in frequent replacement of the garbage bag at home, and generating a phenomenon of wasting garbage bags and environmental pollution.

SUMMARY

At least one embodiment of the present disclosure provides a storage device and a storage bag, the storage device can be utilized to automatically open and/or tighten a storage bag, so as to bring convenience to users and improve user satisfaction.

At least one embodiment of the present disclosure provides a storage device, comprising: a barrel-shaped body, comprising a bottom board and a side wall connected with the bottom board; a storage bag convey member, disposed an outer side of the side wall, and configured to convey a storage bag to a side edge of the side wall away from the bottom board; a first driving part, comprising a rotation part and a rocker arm, the rotation part being disposed on the bottom board, an end of the rocker arm being connected with the rotation part, another end of the rocker arm extends to a side of the side wall away from the bottom board, and the rocker arm being configured to rotate along the side wall under drive of the rotation part, so that an end of the storage bag is dragged to move along the side edge of the side wall away from the bottom board so as to allow the storage bag be opened and/or an opening of the storage bag which is opened be tighten.

For example, in one embodiment of the disclosure, the rocker arm comprises a first rocker arm and a second rocker arm, the rotation part comprises a first rotation part and a second rotation part, an end of the first rocker arm is connected with the first rotation part, and rotates along the side wall under drive of the first rotation part, so that the end of the storage bag is dragged to move along the side edge of the side wall away from the bottom board so as to allow the storage bag be opened; an end of the second rocker arm is connected with the second rotation part, and rotates along the side wall under drive of the second rotation part, so that a partial edge of the opening of the storage bag which is opened is dragged to move along the side edge of the side wall away from the bottom board so as to allow the opening of the storage bag which is opened be tighten.

For example, in one embodiment of the disclosure, the side wall comprises an inside wall, an outside wall and a hollow portion between the outside wall and the inside wall, the first rocker arm and the second rocker arm are disposed in the hollow portion.

For example, in one embodiment of the disclosure, an end portion of the first rocker arm which extends to the side of the side wall away from the bottom board has a first blocking plate, an end portion of the second rocker arm extends to the side of the side wall away from the bottom board has a second blocking plate, a maximum size of the first blocking plate is less than a maximum size of the second blocking plate.

For example, in one embodiment of the disclosure, the storage bag comprises a storage bag body, and a first fixing element and a second fixing element respectively connected with two points on the edge of the opening of the storage bag body, in a compression state, the storage bag body is disposed between the first fixing element and the second fixing element.

For example, in one embodiment of the disclosure, the first fixing element and the second fixing element are C-shaped fixing elements having an approximate shape of C-shape, in the compression state, the storage bag body disposed between the two C-shaped fixing elements has a shape of cylinder with an approximately C-shaped section, an inside diameter of the first fixing element is less than an inside diameter of the second fixing element, the maximum size of the first blocking plate is less than the inside diameter of the second fixing element, and greater than the inside diameter of the first fixing element, the maximum size of the second blocking plate is greater than the inside diameter of the second fixing element.

For example, in one embodiment of the disclosure, the storage bag further comprises: at least one hanging ring, connected with at least one of the first fixing element and the second fixing element, and disposed on a peripheral side of at least one of the first fixing element and the second fixing element.

For example, in one embodiment of the disclosure, a side of the storage bag convey member away from the bottom board comprises a telescoping hook, the telescoping hook is configured to match with the hanging ring of the storage bag conveyed to the side of the storage bag convey member away from the bottom board, and stretch toward to an inner side of the side wall, so that the side edge of the side wall away from the bottom board reaches into an internal of the cylinder and the fixing elements from a notch of the cylinder with the approximately C-shaped section and the C-shaped fixing elements of the storage bag.

For example, in one embodiment of the disclosure, upon the storage bag being in the compression state, the first blocking plate is located between the first fixing element and the second fixing element, or located on a side of the second fixing element away from the first fixing element, the second blocking plate is located on a side of the second fixing element away from the first fixing element.

For example, in one embodiment of the disclosure, the storage bag convey member further comprises: a lifter comprising a guide rail, the storage bag being disposed on the guide rail, the lifter being configured to move the storage bag along the guide rail to the side of the side wall away from the bottom board.

For example, in one embodiment of the disclosure, the side wall is provided with a slot at its outer side and at a position where the storage bag convey member is located, and the lifter is disposed in the slot.

For example, in one embodiment of the disclosure, the storage device further comprises: a lid, connected with the side of the side wall away from the bottom board; and a second driving part, driving the lid to open or close with respect to the barrel-shaped body.

For example, in one embodiment of the disclosure, a side of the lid close to the bottom board is provided with a compression member, the compression member comprises a compression arm and a compression block connected with the compression arm, the compression arm is configured to stretch or compress along a central axis of the barrel-shaped body.

For example, in one embodiment of the disclosure, the storage device further comprises: a first distance measure sensor, disposed on an edge of an inner side of the side wall away from the bottom board or a side of the lid close to the bottom board, and configured to detect a first distance between an object in the storage bag and the side edge of the side wall away from the bottom board; a prompt unit, disposed on the outer side of the side wall or a side of the lid away from the bottom board, and configured to send a warning signal upon the first distance being less than a preset value.

For example, in one embodiment of the disclosure, the storage device further comprises: a second distance measure sensor, disposed on outer side of the side wall or a side of the lid away from the bottom board, and configured to detect a second distance from a user outside the lid to the side wall or the lid.

At least one embodiment of the disclosure provides a storage bag, comprising: a storage bag body, and a first fixing element and a second fixing element respectively connected with two points on an edge of an opening of the storage bag body, the storage bag body is disposed between the first fixing element and the second fixing element, wherein the first fixing element and the second fixing element are C-shaped fixing elements having an approximate shape of C-shape, an inside diameter of the first fixing element is less than an inside diameter of the second fixing element.

For example, in one embodiment of the disclosure, a length of the edge of the opening of the storage bag body between the two points respectively connected with the first fixing element and the second fixing element is less than one-third of an entire circumference of the opening of the storage bag body.

For example, in one embodiment of the disclosure, in a compression state, the storage bag body is located between the first fixing element and the second fixing element, and is compressed to be a cylinder with an approximately C-shaped section.

BRIEF DESCRIPTION OF THE DRAWINGS

In order to clearly illustrate the technical solution of embodiments of the present disclosure, the drawings of the embodiments or related technical description will be briefly described in the following, it is obvious that the drawings in the description are only related to some embodiments of the present disclosure and not limited to the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. "On," "under," "left," "right" and the like are only used to indicate relative position relationship, and when the position of the object which is described is changed, the relative position relationship may be changed accordingly.

At least one embodiment of the present disclosure provides a storage device and a storage bag. The storage device includes a barrel-shaped body, which including a bottom board and a side wall connected with the bottom board; a storage bag convey member, disposed outer side of the side wall, and configured to convey a storage bag to a side edge of the side wall away from the bottom board; a first driving arm, including a rotation part and a rocker arm, the rotation part is disposed on the bottom board, an end of the rocker arm being connected with the rotation part, another end of the rocker arm extending to a side of the side wall away from the bottom board, and being configured to be driven to rotate along the side wall by the rotation part, so that an end of the storage bag is dragged to move along the side edge of the side wall away from the bottom board so as to open the storage bag and/or tighten an opening of the storage bag which is opened. The storage device provided by the present disclosure can be utilized to automatically open and/or tighten a storage bag, so as to bring convenience to users.

Hereinafter, the storage device and the storage bag provided by the embodiments of the present disclosure will be described with reference to the accompanying drawings.

First Embodiment

Figure 1A:
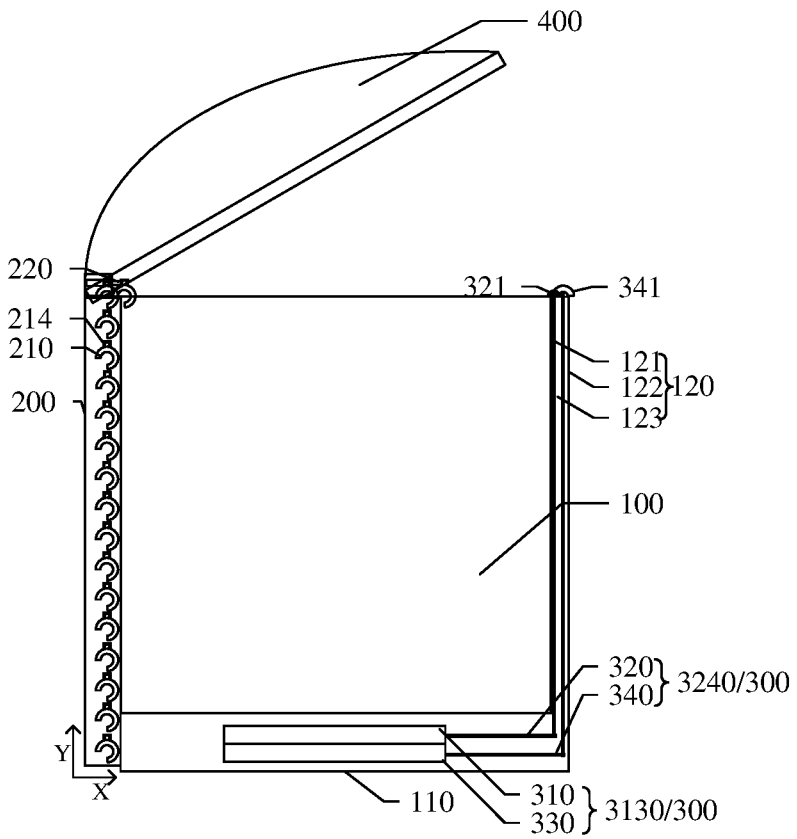
FIG. 1*a* is a schematic view of a storage device provided by an embodiment of the present disclosure.

The present embodiment provides a storage device, as illustrated in FIG. 1*a*, the storage device includes a barrel-shaped body 100, a storage bag convey member 200 and a first driving part 300. The barrel-shaped body 100 includes a bottom board 110 and a side wall 120 connected with the bottom board 110. Here, "the barrel-shaped body" can include a regular barrel-shaped container such as a round barrel or a square barrel etc. as a body of the storage device, the present embodiment is not limited thereto. "The barrel-shaped body" can further includes an irregular barrel-shaped barrel, for example, the irregular barrel-shaped barrel can have a shape of narrow top and wide bottom, wide top and narrow bottom, cone-shape, wide middle and narrow ends, and so on, the present embodiment is not limited thereto, and the present embodiment takes an example that the barrel-shaped body is a round barrel for description. The storage bag convey member 200 is disposed outer side of the side wall 120. For example, the storage bag convey member 200 extends to the side edge of the side wall 120, that is, a top edge of the side wall 120, away from the bottom board 110 in the Y direction. The storage bag convey member 200 provided by the present embodiment is configured to convey a storage bag 210 to the side edge of the side wall 120 away from the bottom board 110. For example, the storage bag convey member 200 can convey the storage bag 210 from a side of the side wall 120 close to the bottom board 110 to a position of the top edge of the side wall 120, the present embodiment includes but is not limited thereto. For example, the storage bag convey member can also include a storage box to store a plurality of storage bags, but the present embodiment is not limited thereto.

As illustrated in FIG. 1*a*, the first driving part 300 in the storage device includes a rotation part 3130 and a rocker arm 3240, the rotation part 3130 is disposed on the bottom board 110, an end of the rocker arm 3240 is connected with the rotation part 3130, another end of the rocker arm 3240 extends to a side of the side wall 120 away from the bottom board 110, and is configured to rotate along the side wall 120 driven by the rotation part 3130, so that an end of the storage bag 210 is dragged to move along the side edge of the side wall 120 away from the bottom board 110 so as to open the storage bag 210 and/or tighten an opening of the storage bag 210 which is opened.

For example, as illustrated in FIG. 1*a*, the rotation part 3130 includes a first rotation part 310, the rocker arm 3240 includes a first rocker arm 320, the first rotation part 310 is disposed on the bottom board 110, but the present embodiment is not limited thereto. For example, the first rotation part 310 can include a rotating machine, but the present embodiment is not limited thereto. For example, the bottom board 110 includes an upper bottom board, a lower bottom board and an interlayer located between the upper bottom board and the lower bottom board, the first rotation part 310 can be disposed in the interlayer between the upper bottom board and lower bottom board. An end of the first rocker arm 320 is connected with the first rotation part 310, another end of the first rocker arm 320 extends to the top edge of the side wall 120, and the first rocker arm 320 is configured to rotate along the side wall 120 driven by the first rotation part 310, that is, the first rocker arm 320 rotates around a central axis of the barrel-shaped body 100, so that the end of the storage bag 210 is dragged to move along the top edge of the side wall 120 so as to open the storage bag 210 in the barrel-shaped body 100. It should be noted that, here, "the storage bag" which is conveyed and unopened refers to a storage bag in a compression state, the first rocker arm drags an end of the storage bag in the compression state to move along the top edge of the side wall, so as to automatically open the storage bag in the compression state, thereby bringing convenience to users and improving user satisfaction.

For example, as illustrated in FIG. 1*a*, upon the first rocker arm 320 being configured to rotate along the side wall 120 driven by the first rotation part 310, so that the end of the storage bag 210 is dragged to move along the side edge of the side wall 120 away from the bottom board 110 so as to open the storage bag 210, the first driving part 300 further includes a second rotation part 330 and a second rocker arm 340, that is, the rotation part 3130 includes the second rotation part 330, the rocker arm 3240 includes the second rocker arm 340. The second rotation part 330 is disposed on the bottom board 110, the present embodiment takes an example that the second rotation part 330 is disposed between the first rotation part 310 and the bottom board 110 for description, the present embodiment is not limited thereto. For example, the second rotation part can also be disposed on a side of the first rotation part away from the bottom board. An end of the second rocker arm 340 is connected with the second rotation part 330, another end of the second rocker arm 340 extends to the top end of the side wall 120, and the second rocker arm 340 is configured to rotate along the side wall 120 driven by the second rotation part 330, that is, rotate around the central axis of the barrel-shaped body 100, so that a part of an opening edge of the storage bag 210 which is opened is dragged to move along the top edge of the side wall so as to tighten the opening of the storage bag 210 which is opened. For example, here, "a part of an opening edge" can be a fixing element on the opening edge of the storage bag mentioned subsequently. It should be noted that, a case that the first rocker arm and the second rocker arm illustrated in FIG. 1*a* both include a part parallel to the bottom board and another part parallel to the side wall is an example, a specific shape of the two rocker arms in the present embodiment is not limited, as long as an end of a rocker arm is connected with the rotation part, another end of the rocker arm extends toward the top edge of the side wall.

The second rocker arm is used in the present embodiment to drag a part of the opening edge of the storage bag which is opened to move along the top edge of the side wall so as to tighten the opening of the storage bag which is opened, thereby automatically tightening the storage bag and bringing convenience to users. The storage device provided by the present embodiment can be applied to a household garbage, the cooperation of the first rocker arm and the second rocker arm can automatically open and tighten the storage bag, which brings convenience to people's life.

For example, as illustrated in FIG. 1*a*, the side wall 120 includes an inside wall 121, an outside wall 122 and a hollow portion 123 between the outside wall 122 and the inside wall 122, the first rocker arm 320 and the second rocker arm 340 are disposed in the hollow portion 123. For example, the inside wall 121 and the outside wall 122 can be parallel in the Y direction, but the present embodiment is not limited thereto. For example, upon the barrel-shaped body being a square barrel or an irregular barrel-shaped barrel, the inside wall 121 is a cylindrical around the central axis of the barrel-shaped body 100.

For example, the first rocker arm 320 can drag the end of the storage bag 210 to move clockwise along the side edge of the side wall 120 away from the bottom board 110 so as to open the storage bag 210, and the first rocker arm 320 can also drag the end of the storage bag 210 to move counterclockwise along the side edge of the side wall away from the bottom board 110 so as to tighten the opening of the storage bag 210 which is opened, the present embodiment includes but is not limited thereto. The present embodiment is mainly described by taking the coordination use of the first rocker arm and the second rocker arm for automatically opening and tightening the storage bag as an example.

For example, a rotation direction of the first rocker arm 320 is the same as that of the second rocker arm 340, that is, the first rocker arm 320 and the second rocker arm 340 both rotate clockwise or counterclockwise around the center axis of the barrel-shaped body 100, the present embodiment includes but is not limited thereto. FIG. 1*a* schematic illustrates that the first rocker arm 320 and the second rocker arm 340 are located on a side of the first rotation part 310 (second rotation part 320) in the X direction. The first rocker arm and the second rocker arm provided by the present embodiment rotate around the center axis of the barrel-shaped body in the hollow portion, which cannot influence the normal work of the storage bag placed in the storage device.

For example, as illustrated in FIG. 1*a*, an end portion of the first rocker arm 320 which extends to the top side of the side wall 120 has a first blocking plate 321, an end portion of the second rocker arm 340 extends to the top side of the side wall 120 has a second blocking plate 341, a maximum size of the first blocking plate 321 is less than a maximum size of the second blocking plate 341.

Figure 1B:
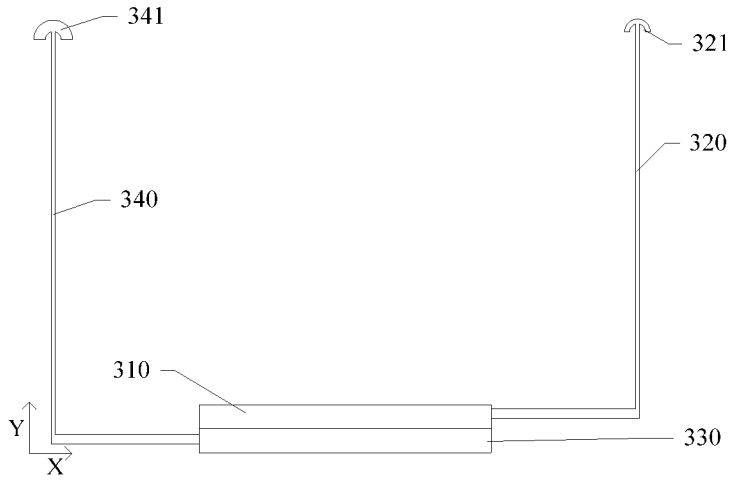
FIG. 1*b* is a schematic view of a first driving part illustrated in FIG. 1*a;*

For example, FIG. 1*b* is a view of the first driving part illustrated in FIG. 1*a*, FIG. 1*b* schematic illustrates that the first rocker arm 320 and the second rocker arm 340 are located on both sides of the first rotation part 310 (the second rotation part 320) in the X direction. As illustrated in FIG. 1*b*, the present embodiment takes an example that sections of the first blocking plate 321 and the second blocking plate 341 have a shape of circular arc for description, in this moment, the maximum sizes of the first blocking plate 321 and the second blocking plate 341 are the maximum sizes in the X direction, and the maximum size of the first blocking plate 321 is less than the maximum size of the second blocking plate 341. For example, the maximum sizes of the first blocking plate 321 and the second blocking plate 341 can be a diameter or a chord length in the X direction. It should be noted that, the sections of the first blocking plate and the second blocking plate provided by the present embodiment can be other shapes, and the maximum sizes of the first blocking plate and the second blocking plate can be sizes in other directions, the present embodiment is not limited thereto.

For example, the storage bag 210 illustrated in FIG. 1*a* is a section view of the storage bag in the compression state, the storage bag 210 in the compression state includes a first fixing element, a second fixing element and a storage bag body disposed between the first fixing element and the second fixing element, C-shaped sections illustrated in FIG. 1*a* are section shapes of the fixing elements, the mentioned C-shape is an approximate shape of C-shape, and the subsequently described "C-shape" is the approximate shape of C-shape. For example, as illustrated in FIG. 1*a*, the storage bag 210 further includes at least one hanging ring 214, the hanging ring 214 is connected with at least one of the first fixing element and the second fixing element, and is disposed on a peripheral side of at least one of the first fixing element and the second fixing element. For example, the present embodiment takes an example that the storage bag 210 includes two hanging rings 214 for description, and the present embodiment includes but is not limited thereto. For example, the hanging rings 214 are respectively connected with the two fixing elements, and is disposed on a side of the first fixing element (the second fixing element) away from the bottom board 110 in the Y direction.

For example, as illustrated in FIG. 1*a*, a side of the storage bag convey member 200 away from the bottom board 110 provided by the present embodiment includes a telescoping hook 220, that is, a vertical distance from the telescoping hook 220 to the bottom board 110 is not less than a size of the side wall 120 in the Y direction (a length of the side wall 120 in the Y direction). The telescoping hook 220 is configured to match with the hanging ring 214 of the storage bag 210 conveyed to the side of the storage bag convey member 200 away from the bottom board 110, that is, the storage bag 210 is conveyed to a position where the telescoping hook 220 is located, the telescoping hook 220 can insert the hanging ring 214 of the storage bag 210, and drag the storage bag 210 to move. After the telescoping hook 220 is combined with the storage bag 210, the telescoping hook 220 stretches toward to the inner side of the side wall 120, so that the side edge of the side wall 120 away from the bottom board 110 reaches into an internal of the cylinder and the fixing elements from a notch of the cylinder with an approximately C-shaped section and the C-shaped fixing elements of the storage bag 210, the combination of the telescoping hook and the storage bag provided by the present embodiment can achieve a function that the storage bag is automatically conveyed into the barrel-shaped body.

Figure 2A:
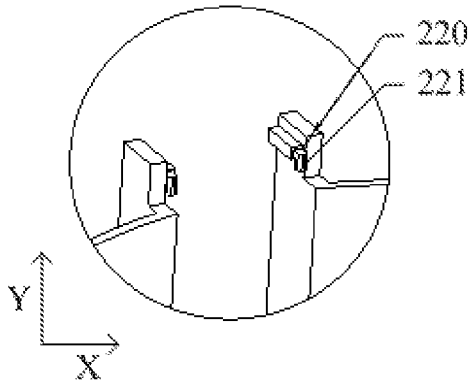
FIG. 2*a* to FIG. 2*c* are schematic views illustrating working procedure charts of a telescoping hook provided by an embodiment of the present disclosure.
Figure 2B:
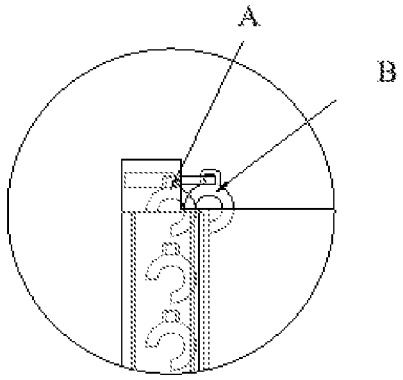
Figure 2C:
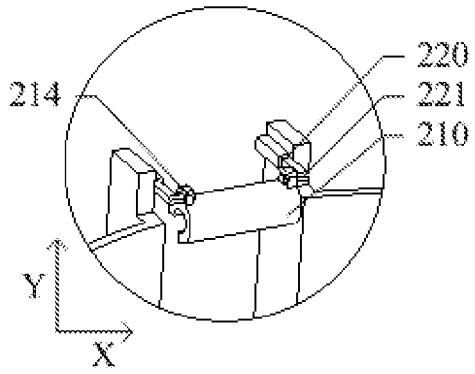

For example, FIG. 2*a* to FIG. 2*c* are schematic view illustrating the working procedure of the telescoping hook. As illustrated in FIG. 2*a*, the telescoping hook 220 includes a padlock 221. In an initial state, the padlock 221 extends in an opposite direction to the Y direction, that is, the padlock 221 is downward. In should be noted that, a distance between the two telescoping hook 220 is greater than a distance between the two fixing elements of the storage bag 210 in the compression state.

For example, as illustrated in FIG. 2*b* to FIG. 2*c*, upon the storage bag 210 being automatically conveyed between the two telescoping hooks 220 through the storage bag convey member 200, that is, the storage bag 210 being conveyed to the position A, the padlock 221 of the telescoping hook 220 is turned inward (where the storage bag is located) and stretched to just insert into the hanging ring 214, and then the telescoping hook 220 is stretched to the inner side of the side wall 120 so as to convey the storage bag 210 to a position where the storage bag 210 can be set to the top edge of the side wall 120, that is, the telescoping hook 220 can convey the storage bag 210 to the position B so as to set the storage bag 210 to the top edge of the side wall 120.

Figure 3A:
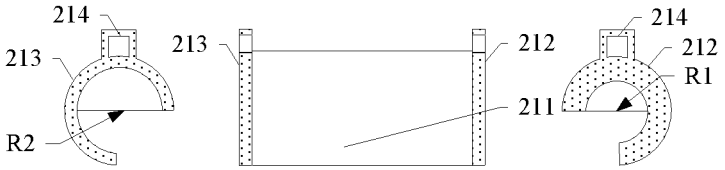
FIG. 3*a* is a schematic view of a storage bag in a compression state provided by an embodiment of the present disclosure.

For example, FIG. 3*a* is a schematic view of the storage bag in a compression state provided by the present embodiment, as illustrated in FIG. 3*a*, the storage bag includes a storage bag body 211 and the first fixing element 212 and the second fixing element 213 respectively connected to two points on an opening edge of the storage bag body 211, the storage bag body 211 is disposed between the first fixing element 212 and the second fixing element 213. For example, materials of the section of the first fixing element 212 and the second fixing element 213 are rigid plastic, the storage bag body 211 is a soft plastic bag compressed between the first fixing element 212 and the second fixing element 213, and the present embodiment includes but is not limited thereto.

For example, as illustrated in FIG. 3*a*, the first fixing element 212 and the second fixing element 213 are C-shaped fixing elements, the "C-shape" herein relates to the approximate shape of C-shape, for example, which can include shapes such as circular arc, U-shape or V-shape and so on, the present embodiment is not limited thereto. The present embodiment takes an example that the C-shape is the circular arc for description, and the fixing elements with the circular arc section are configured to set on the top edge of the side wall 120. The storage bag body 211 disposed between the two C-shaped fixing elements has a shape of cylinder with a C-shaped section. As illustrated in FIG. 3*a*, an inside diameter R1 of the first fixing element 212 is less than an inside diameter R2 of the second fixing element 213, the inside diameter herein is a diameter of an inner ring of the C-shaped section. It should be noted that, upon the sections of the first fixing element and the second fixing element being not circular arcs, the inside diameter of the first fixing element and the inside diameter of the second fixing element respectively refer diameters of inscribed circles of the first fixing element and the second fixing element.

Figure 3B:
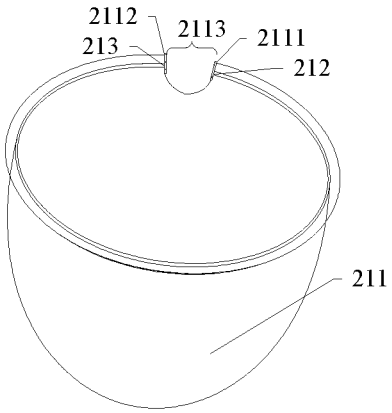
FIG. 3*b* is a schematic view of an opened storage bag provided by an embodiment of the present disclosure.

For example, FIG. 3*b* is a view of the storage bag which is opened provided by the present embodiment, as illustrated in FIG. 3*b*, the opening of the storage bag body 211 is unclosed, that is, the opening includes a gap 2113, two ends of the gap 2113 are the two points 2111 and 2112 of the opening edge, the present embodiment takes an example that the two points 2111 and 2112 of the opening edge are respectively connected with the first fixing element 212 and the second fixing element 213 for description, but the present embodiment is not limited thereto.

Figure 4A:
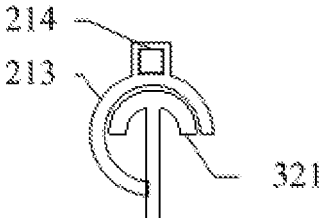
FIG. 4*a* to FIG. 4*c* are schematic views showing a relationship between a size of a blocking plate and a size of a fixing element provided by an embodiment of the present disclosure.
Figure 4B:
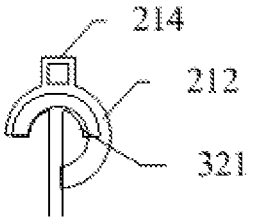
Figure 4C:
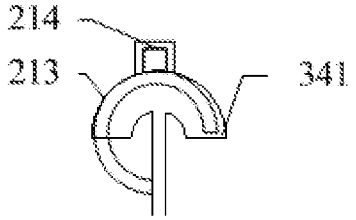

For example, FIG. 4*a* to FIG. 4*c* are schematic views showing a relationship between a size of a blocking plate and a size of a fixing element provided by the present embodiment. As illustrated in FIG. 4*a*, the maximum size of the first blocking plate 321 is less than the inside diameter R2 of the second fixing element 213. As illustrated in FIG. 4*b*, the maximum size of the first blocking plate 321 is greater than the inside diameter R1 of the first fixing element 212. As illustrated in FIG. 4*c*, the maximum side of the second blocking plate 341 is greater than the inside diameter R2 of the second fixing element 213.

Figure 5A:
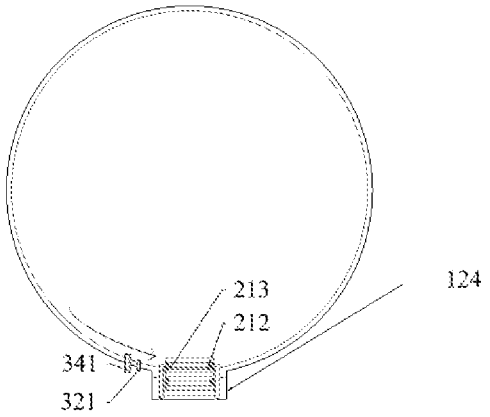
FIG. 5*a* to FIG. 5*b* are top views of a rotating process that a first fixing element of a storage bag in a compression state is dragged by a first blocking plate provided by an embodiment of the present disclosure.
Figure 5B:
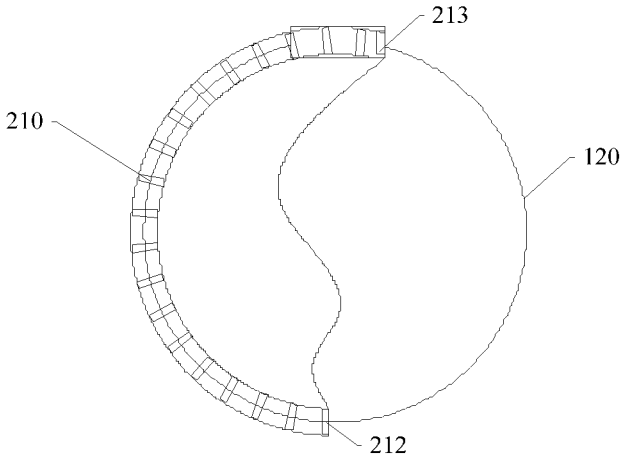

For example, FIG. 5*a* and FIG. 5*b* are top views of a rotating process that the first fixing element 212 of the storage bag in the compression state is dragged by the first blocking plate 321. As illustrated in FIG. 1*a* and FIG. 5*a*, upon the storage bag 220 being in the compression state, the first blocking plate 321 can be on a side of the second fixing element 213 away from the first fixing element 212, because the maximum size of the first blocking plate 321 is less than the inside diameter R2 of the second fixing element 213, in a process that the first rocker arm 320 is driven by the first rotation part 310 to rotate (clockwise rotate) around the center axis of the barrel-shaped body 100, the first blocking plate 321 of the first rocker arm 320 can pass through the inside of the second fixing element 213, and enter between the first fixing element 212 and the second fixing element 213. The present embodiment includes but is not limited thereto, for example, upon the storage bag 220 being in the compression state, the first blocking plate 321 can also be located between the first fixing element 212 and the second fixing element 213. It should be noted that, upon the storage bag 220 being in the compression state, the second blocking plate 341 is only located on a side of the second fixing element 213 away from the first fixing element 212, and is located on a side of the first blocking plate 321 away from the first fixing element 212.

For example, after the first blocking plate 321 moves from the side of the second fixing element 213 away from the first fixing element 212 to between the first fixing element 212 and the second fixing element 213, because the maximum size of the first blocking plate 321 is greater than the inside diameter R1 of the first fixing element 212, the first fixing element 212 of the storage bag 210 can be dragged by the first blocking plate 321 to perform a counterclockwise circumferential movement along the side wall 120, so that the storage bag 210 in the compression state can be opened in the barrel-shaped body 100, so as to automatically open the storage bag in the compression state, bring convenience to users and improve the user satisfaction.

It should be noted that, before the first blocking plate 321 rotates to the nearby of the position where the first fixing element 212 is located and drives the first fixing element 212 to move, the padlock of the telescoping hook 220 inserted in the hanging ring 214 of the first fixing element 212 is retracted to be removed from the hanging ring 214, and turned downward to return to the initial state, and then the telescoping hook 220 is retracted outer side of the side wall 120 to return to the initial position. In addition, upon the first fixing element 212 being driven by the first blocking plate 321, the padlock inserted in the second fixing element 213 can include at least one protrusion to stuck the hanging ring 214 of the second fixing element 213, so as to prevent the second fixing element 213 from performing the circumferential movement following the first fixing element 212, the present embodiment includes but is not limited thereto, the second fixing element 213 can be prevented from performing the circumferential movement following the first fixing element 212 through other manners.

For example, as illustrated in FIG. 1*a* and FIG. 5*b*, upon the storage bag 210 in the compression state being opened, the second fixing element 213 does not move, the first fixing element 212 is set on the top edge of the side wall 120, and rotates around the center axis of the barrel-body 100. For example, a plurality of fixing elements having the same shape as the second fixing element 213 are disposed between the first fixing element 212 and the second fixing element 213, these fixing elements are sequentially set on the top edge of the side wall 120 during the rotation process of the first fixing element 212, the present embodiment includes but is not limited thereto. In a case that the first fixing element 212 is rotated counterclockwise around the center axis of the barrel-body 100 to a position close to the second fixing element 213, the storage bag 210 has fully opened.

Figure 5C:
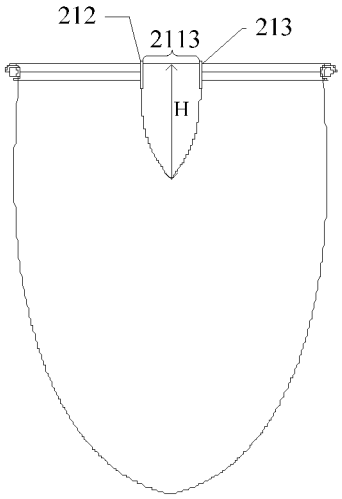
FIG. 5*c* is a side view of a fully opened storage bag provided by an embodiment of the present disclosure.

For example, FIG. 5*c* is a side view of a fully opened storage bag, as illustrated in FIG. 1*a* and FIG. 5*c*, there is a notch 2113 between the first fixing element 212 and the second fixing element 213. For example, the edge of the storage bag body at the notch 2113 between the first fixing element 212 and the second fixing element 213 has elasticity, so that the storage bag cannot be teared during the opening process, the present embodiment includes but is not limited thereto. For example, a linear distance (at the position of the notch) of an interval between the first fixing element 212 and the second fixing element 213 can be 1.5-2 times of the size of the storage bag body between the first fixing element 212 and the second fixing element 213 after the storage bag 210 is compressed. For example, a length of the opening edge of the storage body between the two points respectively connected with the first fixing element 212 and the second fixing element 213 is less than one-third of an entire opening circumference of the storage bag body. For example, a depth H of the gap 2113 in the Y direction is not greater than a size of the radius of the circular barrel-shaped body 100, but the present includes but is not limited thereto.

Figure 5D:
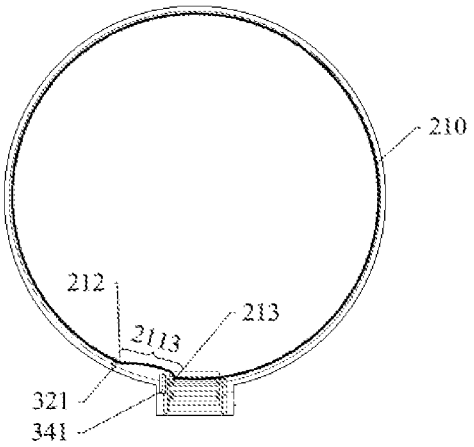
FIG. 5*d* to FIG. 5*e* are top views of a fully opened storage bag provided by an embodiment of the present disclosure.
Figure 5E:
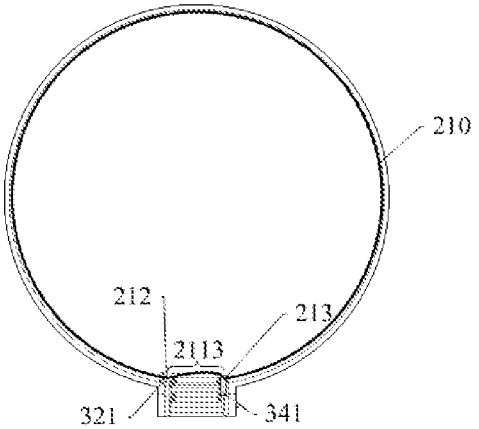

For example, FIG. 5*d* to FIG. 5*e* are top views of a fully opened storage bag, as illustrated in FIG. 1*a* and FIG. 5*d*, after the storage bag 210 is fully opened, the first blocking plate 321 continues to drive the first fixing element 212 to rotate counterclockwise, at this moment, because the maximum size of the second blocking plate 341 is greater than the inside diameter R2 of the second fixing element 213, the second fixing element 213 can be removed from the telescoping hook 220 under the impulse of the second blocking plate 341 which is moved counterclockwise, and then the second fixing element 213 can move following the counterclockwise movement of the first fixing element 212, until the first fixing element 212 moves to the position illustrated in FIG. 5*e*, the top edge of the side wall 120 at the position is provided with a fastener (which is not illustrated in FIG. 5*d* to FIG. 5*e*), the fastener can exactly fix the first fixing element 212, at this moment, the second fixing element 213 has set on the top edge of the side wall. It should be noted that, FIG. 5*d* is a schematic view provided by the present embodiment, and the present embodiment takes an example that the second fixing element 213 is still fixed on the telescoping hook 220 for description, the present embodiment includes but is not limited thereto.

For example, after the storage bag 210 is full of objects, the second rocker 340 is driven by the second rotation part 330, so that the second fixing element 213 is driven by the second blocking plate 341 to rotate counterclockwise around the center axis of the barrel-shaped body 100, and the second fixing element is rotated to a position close to the first fixing element 212, so as to tighten the storage bag 210 which is opened. The storage device provided by the present embodiment can automatically tighten the storage bag, so as to bring convenience to users and improve the user satisfaction.

For example, the storage device provided by the present embodiment further includes a control unit (which is not illustrated in figures), the control unit is connected with the first driving part so as to control the first driving part, and the present embodiment includes but is not limited thereto.

Figure 6:
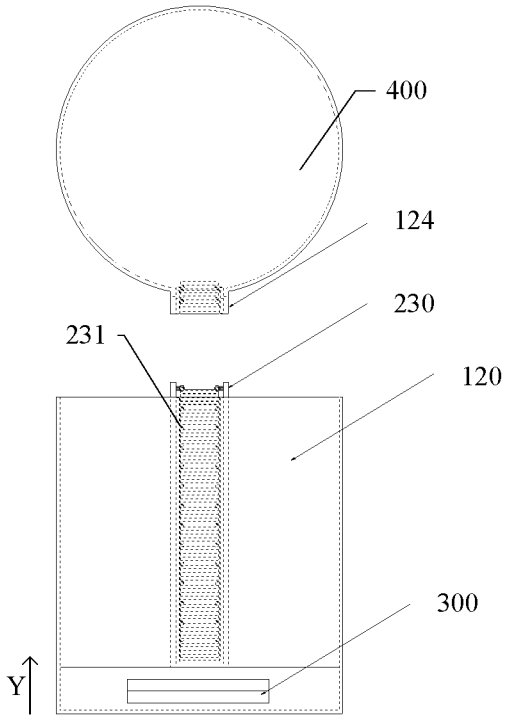
FIG. 6 is a side view of a storage device provided by an embodiment of the present disclosure.

For example, FIG. 6 is a side view of the storage device provided by the present embodiment, as illustrated in FIG. 1*a* and FIG. 6, the storage bag convey member 200 further includes a lifter 230. After the storage bag 210 in the barrel-shaped body 100 is taken away, the storage device provided by the present embodiment repeats an action of automatically conveying the storage bag and opening the storage bag 210 in the compression state, that is, the other new storage bags 210 in the compression state is automatically conveyed to the top edge of the side wall 120 through the lifter 230, and then the storage bag 210 is combined with the telescoping hook 220, so as to be conveyed into the barrel-shaped body 100 and set on the top edge of the side wall 120. Finally, the first rocker arm 320 is driven by the first rotation part 310 to drag the first fixing element to move along the top edge of the side wall 120, so as to open the storage bag 210 in the compression state.

For example, as illustrated in FIG. 1*a* and FIG. 6, the lifter 230 includes a guide rail 231, the storage bag 219 is disposed on the guide rail 231, and the lifter 230 is configured to move the storage bag 210 along the guide rail 231 to the side of the side wall 120 away from the bottom board 110. The present embodiment takes an example that the guide rail 231 extends in the Y direction for description, but the present embodiment is not limited thereto. For example, the guide rail can further include a part extending parallel to the bottom board.

For example, as illustrated in FIG. 1*a* and FIG. 6, the side wall 120 is provided with a slot 124 at its outer side and a position where the storage bag convey member 200 is located, the lifter 230 can be disposed in the slot 124, and the present embodiment includes but is not limited thereto.

For example, as illustrated in FIG. 1*a* and FIG. 6, the storage device provided by the present embodiment further includes a lid 400, which is connected with the side of the side wall 120 away from the bottom board 110. For example, the lip 400 can be pivotally connected with a part of the side wall 120, that is, the lip 400 is pivotally connected with a part of the top edge of side wall 120. The connection manner between the lip and the side wall is not limit in the present embodiment, and the lip can be connected with the side wall in other connection manners in addition to the pivotal connection.

Figure 7:
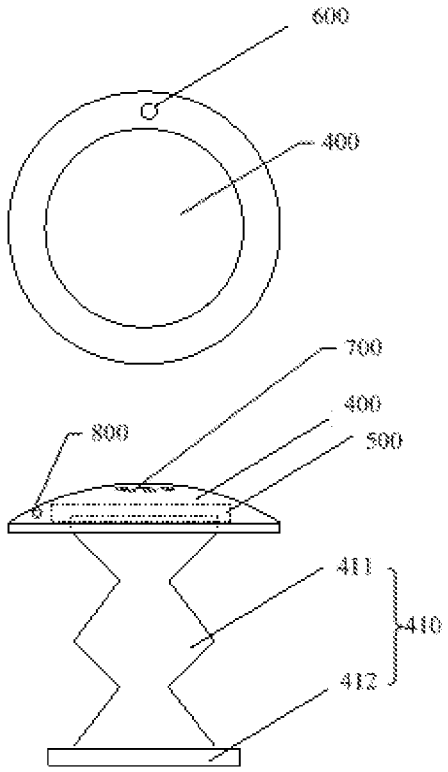
FIG. 7 is a structure view of a lid provided by an embodiment of the present disclosure.

For example, FIG. 7 is a structure view of the lip provided by the present embodiment, as illustrated in FIG. 1*a* and FIG. 7, the storage device provided by the present embodiment further includes a first distance measure sensor 600. FIG. 7 takes an example that the first distance measure sensor 600 is disposed on a side of the lip 400 close to the bottom board 110 upon the lip 400 being closed for description, that is, the lip 400 shown in the upper part of FIG. 7 is the inner side of the lip 400. The present embodiment includes but is not limited thereto, for example, the first distance measure sensor can also disposed on the edge of the inside of the side wall away from the bottom board, that is, the first distance measure sensor can also be disposed on the top edge of the inside of the side wall. The first distance measure sensor 600 is configured to detect a first distance S1 between an object in the storage bag 210 and the side edge of the side wall 120 away from the bottom board 110, that is, the first distance measure sensor 600 is configured to detect the first distance S1 between the object in the storage bag 210 and the inner side of the lip 400. For example, the first distance measure sensor 600 can be an infrared sensor, the present embodiment is not limited thereto, and the first distance measure sensor can be other distance measure sensors.

For example, the first distance measure sensor 600 and the storage bag convey member 200 are respectively connected with the control unit, the first distance measure sensor 600 transmits a detected data of the first distance S1 to the control unit, the control unit determines that upon the first distance S1 being equal to a distance from the inner side of the lip 400 to the bottom board 110, that is, when the control unit determines that there is no storage bag 210 in the barrel-shaped body 100, the control unit controls the storage bag convey member 200 to automatically convey the storage bag 210 into the barrel-shaped body 100.

It should be noted that, the present embodiment is not limited thereto, for example, the first distance measure sensor 600 can also be connected with the storage bag convey member 200. For example, the first distance measure sensor 600 is an infrared sensor, upon the infrared sensor sensing that there is no storage bag in the barrel-shaped body 100, the infrared sensor transmits a signal to the storage bag convey member 200 to start the storage bag convey member 200 to convey the storage bag 210 into the barrel-shaped body 100. Upon the storage bag 210 being conveyed to a designated position, a switch of the first driving part 300 is triggered, for example, the designated position is provided with the switch for controlling the opening of the first driving part 300, in a case that the storage bag 210 is conveyed to the designated position, the switch of the first driving part 300 is turned on to drive the first rocker arm 320 to open the storage bag 210 in the barrel-shaped body 100.

For example, as illustrated in FIG. 1*a* and FIG. 7, the storage device further includes a prompt unit 700. FIG. 7 takes an example that the prompt unit 700 is disposed on the side of the lid 400 away from the bottom board 110 for description, the present embodiment includes but is not limited thereto. For example, the prompt unit can also be disposed on the outer side of the side wall or other positions. For example, the prompt unit 700 is connected with the control unit, the first distance measure sensor 600 transmits the detected data signal of the first distance S1 to the control unit, upon the control unit determining that the first distance S1 is less than the first preset value L1, the storage bag 210 are considered to be full, the storage bag 210 needs to be changed, and the control unit controls the prompt unit 700 to send a reminder. Here, "the first preset value L1" can be a range of ⅛ to 1/10 of the size of the side wall 120 in the Y direction, and the present embodiment includes but is not limited thereto. For example, the prompt unit 700 can also be connected with the first distance measure sensor 600. Upon the first distance measure sensor 600 detecting that the first distance S1 is less than the first preset value L1, the first distance measure sensor 600 transmits the signal to the prompt unit 700 to start the prompt unit 700 to send the warning signal.

In the present embodiment, upon the control unit determining that the first distance S1 is less than the first preset value L1, the storage bag 210 are considered to be full, and the control unit controls the first driving part 300 to drive the second rocker arm 340 to drag the second fixing element of the storage bag 210 to rotate along the top edge of the side wall 120, so as to tighten the opening of the storage bag 210, and then the control unit controls the prompt unit 700 to send the warning signal to remind the user to take off the storage bag 210 in the barrel-shaped body 100, the present embodiment includes but is not limited thereto.

For example, as illustrated in FIG. 7, the storage device further includes a second driving part 500, which is configured to drive the lid 400 to open or close with respect to the barrel-shaped body 100. For example, the second driving part 500 is connected with the control unit, the second driving part 500 is controlled by the control unit to drive the lid 400 to open or close with respect to the barrel-shaped body 100. The present embodiment includes but is not limited thereto, for example, the second driving part 500 can also directly control the lid 400 to open or close with respect to the barrel-shaped body 100. For example, the second driving part 500 is disposed in the lip 400, and the present embodiment includes but is not limited thereto.

For example, as illustrated in FIG. 1*a* and FIG. 7, a side of the lid 400 close to the bottom board 110 is provided with a compression member 410 when the lid 400 is closed, the compression member 410 includes a compression arm 411 and a compression block 412 connected with the compression arm 411, the compression arm 411 is configured to stretch or compress along the central axis of the barrel-shaped body 100, that is, the compression arm 411 moves toward to or away from the bottom board 110 along the central axis of the barrel-shaped body 100. For example, the compression member 410 is connected with the second driving part 500, the second driving part 500 drives the compression member 410, so that the compression arm 411 can drag the compression block 412 to stretch or compress along the central axis of the barrel-shaped body 100.

For example, the first distance measure sensor 600 transmits the detected first distance S1 to the control unit, upon the control unit determining that the first distance S1 is less than a second preset value L2, the control unit controls the second driving part 500 to drive the compression member 410, so that the compression arm 411 can drag the compression block 412 to stretch along the central axis of the barrel-shaped body 100, that is, the compression arm 411 can drag the compression block 412 to move toward to the bottom board 110 along the central axis of the barrel-shaped body 100, so as to compress the objects in the storage bag 210. Here, "the second preset value L2" can be a range of ½ to ⅓ of the size of the side wall 120 in the Y direction, and the present embodiment includes but is not limited thereto.

For example, the first distance measure sensor 600 can also be directly connected with the second driving part 500, upon the detected first distance S1 being less than the second preset value L2, the first distance measure sensor 600 transmits a signal to the second driving part 500 to start the second driving part 500, the second driving part 500 drives the compression member 410 to compress the objects in the storage bag 210.

For example, a compression force of the compression block 412 on the objects is 50N, and the present embodiment includes but is not limited thereto. For example, upon a compression distance of the compression block 412 on the objects being less than 5 cm, that is, in a case that the objects are compressed by the compression block 412, and the first distance S1 detected by the first distance measure sensor 600 is less than the first preset value L1, the control unit controls the prompt unit 700 to send a warning signal. It should be noted that, herein, "a compression distance of the compression block 412 on the objects being less than 5 cm" is only an example, a specific size of the compression distance of the compression block on the objects can be determined according to a height of the side wall of the storage device in the direction perpendicular to the bottom board. The compression member provided by the present embodiment can achieve the compression on the objects in the storage bag so as to increase density of the objects in each storage bag, thereby saving the use of the storage bag.

For example, as illustrated in FIG. 7, the storage device provided by the present embodiment further includes a second distance measure sensor 800, FIG. 7 takes an example that the second distance sensor 800 is disposed on a side of the lid 400 away from the bottom board 100 (outer side of the lip 400) for description, and the present embodiment includes but is not limited thereto. For example, the second distance measure sensor can further be disposed on the outer side of the side wall. For example, upon the first distance measure sensor 600 and the second distance measure sensor 800 being both disposed on the lip 400, a mutual interference between two distance measure sensors can be prevented by the lip 400 made of a metal material or the like.

For example, the second distance measure sensor 800 is electrically connected with the control unit, and is configured to detect a second distance S2 from a user outside the lid 400 to the lid 400, and transmit a data of the second distance S2 to the control unit. Upon the second distance S2 being less than a third preset value L3, the control unit is configured to control the second driving part 500 to drive the lip 400 to open relative to the barrel-shaped body 100. Upon the second distance S2 being greater than a third preset value L3, the control unit is configured to control the second driving part 500 to drive the lip 400 to close relative to the barrel-shaped body 100, and the present embodiment includes but is not limited thereto.

For example, the second distance measure sensor 800 can be an infrared sensor, the lip can be automatically opened when the second distance measure sensor 800 senses a user within a certain range around the storage device, the present embodiment is not limited thereto, and the second distance measure sensor can be other distance measure sensors.

The storage device provided by the present embodiment has a function of automatically placing, opening, and tightening the storage bag. The density of the objects in each storage bag can be increased through compressing the objects in the storage bag by the compression member, so as to save the use of the storage bag. And the lid of the storage device can be automatically opened upon a user being detected to be close to the storage device, and the lid of the storage device can be automatically closed upon a user being detected to be away from the storage device, so as to bring convenience to users and improve the user satisfaction.

The storage device provided by the present embodiment can be applied to a household garbage, a household storage box, and a manufacturing package industry and other fields, but the present embodiment is not limited thereto.

Second Embodiment

The present embodiment provides a storage bag, as illustrated in FIG. 3*a* and FIG. 3*b*, the storage bag 210 provided by the present embodiment includes a storage bag body 211 and a first fixing element 212 and a second fixing element 213 respectively connected with two points on an opening edge of the storage bag body 211, the storage bag body 211 is disposed between the first fixing element 212 and the second fixing element 213, and the shape of the storage bag body 211 is a cylinder with an approximately C-shaped section in a compression state. The first fixing element 212 and the second fixing element 213 are C-shaped fixing elements having an approximate shape of C-shape, an inside diameter R1 of the first fixing element 212 is less than an inside diameter R2 of the second fixing element 213. The "C-shape" herein relates to the approximate shape of C-shape, for example, which can include shapes such as circular arc, U-shape or V-shape and so on, the present embodiment is not limited thereto the present embodiment takes an example that the C-shape is the circular arc for description. It should be noted that, upon the first fixing element and the second fixing element being not circular arcs, the inside diameter of the first fixing element and the inside diameter of the second fixing element respectively refer diameters of inscribed circles of the first fixing element and the second fixing element.

For example, as illustrated in FIG. 3*b*, the storage bag body 211 which is opened is provided with a point 2111 connected with the first fixing element 212, the storage bag body 211 which is opened is provided with a point 2112 connected with the second fixing element 213, and there is a notch 2113 between the two points. A length of the opening edge of the storage bag body 211 in the notch 2113 is less than one-third of an entire opening circumference of the storage bag body 211, that is, the length of the opening edge between the two points is less than one-third of the entire opening circumference of the storage bag body 211, and the present embodiment includes but is not limited thereto. For example, a linear distance between the two points respectively connected with the first fixing element 212 and the second fixing element 213 can be 1.5-2 times of the size of the storage bag body 210 between the first fixing element 212 and the second fixing element 213 after the storage bag 210 is compressed, and the present embodiment includes but is not limited thereto.

It should be noted that, the storage bag 210 provided by the present embodiment is utilized to be combined with the storage device provided by the first embodiment, and has the same technical features as the storage bag 210 described in the first embodiment.

The storage bag provided by the present embodiment can be together used with the storage device provided by the first embodiment to achieve a function of automatically placing, opening, and tightening the storage bag, so as to bring convenience to users and improve the user satisfaction.

In embodiments of the present disclosure, the prompt unit and the control unit, and so on can be implemented in software for execution by various types of processors. For example, an identified executable code module may include one or more physical or logical blocks of computer instructions, for example, the identified executable code module can be built as an object, procedure or function. Nevertheless, an executable code module of a controller does not need to be physically located together, but may include different instructions stored in different physics. Upon the instructions being logically combined, they constitute the prompt unit and the control unit and so on, and a prescribed purpose of the controller can be achieved.

In fact, the executable code module can be a single instruction or a plurality of instructions, and can even be distributed on a plurality of different code segments, distributed among different programs, and distributed across a plurality of memory devices. Similarly, an operational data can be identified within the module, and can be implemented in any suitable form, and organized within any suitable type of data structure. The operational data can be collected as a single data set, or can be distributed at different locations (including a case of distributing on different storage devices), and can at least partially exist on the system or network only as an electronic signal.

The prompt unit and the control unit and so on can be implemented in software, in a case that the prompt unit and the control unit can be implemented by using software. In consideration of the technical level of the existing hardware, those skilled in the art can build a corresponding hardware circuit to achieve the functions corresponding to functions of the prompt unit and the control unit which are implemented in software without considering the cost. The hardware circuit includes a conventional very large scale integration (VLSI) circuit, or a gate array, and existing semiconductors such as a logic chip, a transistor, or other discrete components. The prompt unit and the control unit can also be implemented with a programmable hardware device, such as a field programmable gate array, programmable array logic, a programmable logic device, etc.

The following points should to be explained:

(1) Unless otherwise defined, in the embodiments and accompanying drawings in the present disclosure, the same reference numeral represents the same meaning.

(2) The accompanying drawings involve only the structure(s) in connection with the embodiment(s) of the present disclosure, and other structure(s) can be referred to common design(s).

(3) For the purpose of clarity, in accompanying drawings for illustrating the embodiment(s) of the present disclosure, layer(s) or area(s) may be enlarged. However, it should understood that, in the case in which a component or element such as a layer, film, area, substrate or the like is referred to be "on" or "under" another component or element, it may be directly on or under the another component or element or a component or element is interposed therebetween.

The foregoing is only the embodiments of the present invention and not intended to limit the scope of protection of the present invention, alternations or replacements which can be easily envisaged by any skilled person being familiar with the present technical field shall fall into the protection scope of the present disclosure. Thus, the protection scope of the present disclosure should be based on the protection scope of the claims.

What is claimed is:

1. A storage device configured to automatically open and tighten a storage bag, the storage device comprises:

a barrel-shaped body, comprising a bottom board and a side wall connected with the bottom board;

a storage bag convey member, disposed an outer side of the side wall, and configured to convey an entirety of the storage bag in a compression state to a side edge of the side wall away from the bottom board;

a first driving part, comprising a rotation part and a rocker arm, the rotation part being disposed on the bottom board, an end of the rocker arm being connected with the rotation part, another end of the rocker arm extends to a side of the side wall away from the bottom board, and the rocker arm being configured to rotate along the side wall under drive of the rotation part, so that an end of the storage bag is dragged to move along the side edge of the side wall away from the bottom board so as to allow the storage bag be opened and/or an opening of the storage bag which is opened be tighten.

2. A storage device configured to automatically open and tighten a storage bag, the storage device comprises:

a barrel-shaped body, comprising a bottom board and a side wall connected with the bottom board;

a storage bag convey member, disposed an outer side of the side wall, and configured to convey the storage bag to a side edge of the side wall away from the bottom board;

a first driving part, comprising a rotation part and a rocker arm, the rotation part being disposed on the bottom board, an end of the rocker arm being connected with the rotation part, another end of the rocker arm extends to a side of the side wall away from the bottom board, and the rocker arm being configured to rotate along the side wall under drive of the rotation part, so that an end of the storage bag is dragged to move along the side edge of the side wall away from the bottom board so as to allow the storage bag be opened and/or an opening of the storage bag which is opened be tighten, wherein the rocker arm comprises a first rocker arm and a second rocker arm, the rotation part comprises a first rotation part and a second rotation part, an end of the first rocker arm is connected with the first rotation part, and rotates along the side wall under drive of the first rotation part, so that the end of the storage bag is dragged to move along the side edge of the side wall away from the bottom board so as to allow the storage bag be opened;

an end of the second rocker arm is connected with the second rotation part, and rotates along the side wall under drive of the second rotation part, so that a partial edge of the opening of the storage bag which is opened is dragged to move along the side edge of the side wall away from the bottom board so as to allow the opening of the storage bag which is opened be tighten.

3. The storage device according to claim 2, wherein the side wall comprises an inside wall, an outside wall and a hollow portion between the outside wall and the inside wall, the first rocker arm and the second rocker arm are disposed in the hollow portion.

4. The storage device according to claim 2, wherein an end portion of the first rocker arm which extends to the side of the side wall away from the bottom board has a first blocking plate, an end portion of the second rocker arm extends to the side of the side wall away from the bottom board has a second blocking plate, a maximum size of the first blocking plate is less than a maximum size of the second blocking plate.

5. The storage device according to claim 4, wherein the storage bag comprises a storage bag body, and a first fixing element and a second fixing element respectively connected with two points on the edge of the opening of the storage bag body, in a compression state, the storage bag body is disposed between the first fixing element and the second fixing element.

6. The storage device according to claim 5, wherein the first fixing element and the second fixing element are C-shaped fixing elements having an approximate shape of C-shape, in the compression state, the storage bag body disposed between the two C-shaped fixing elements has a shape of cylinder with an approximately C-shaped section, an inside diameter of the first fixing element is less than an inside diameter of the second fixing element, the maximum size of the first blocking plate is less than the inside diameter of the second fixing element, and greater than the inside diameter of the first fixing element, the maximum size of the second blocking plate is greater than the inside diameter of the second fixing element.

7. The storage device according to claim 5, wherein the storage bag further comprises:

at least one hanging ring, connected with at least one of the first fixing element and the second fixing element, and disposed on a peripheral side of at least one of the first fixing element and the second fixing element.

8. The storage device according to claim 7, wherein a side of the storage bag convey member away from the bottom board comprises a telescoping hook, the telescoping hook is configured to match with the hanging ring of the storage bag conveyed to the side of the storage bag convey member away from the bottom board, and stretch toward to an inner side of the side wall, so that the side edge of the side wall away from the bottom board reaches into an internal of the cylinder and the fixing elements from a notch of the cylinder with the approximately C-shaped section and the C-shaped fixing elements of the storage bag.

9. The storage device according to claim 5, wherein, upon the storage bag being in the compression state, the first blocking plate is located between the first fixing element and the second fixing element, or located on a side of the second fixing element away from the first fixing element, the second blocking plate is located on a side of the second fixing element away from the first fixing element.

10. The storage device according to claim 1, wherein the storage bag convey member further comprises:

a lifter comprising a guide rail, the storage bag being disposed on the guide rail, the lifter being configured to move the storage bag along the guide rail to the side of the side wall away from the bottom board.

11. The storage device according to claim 10, wherein the side wall is provided with a slot at its outer side and at a position where the storage bag convey member is located, and the lifter is disposed in the slot.

12. The storage device according to claim 1, further comprising:

a lid, connected with the side of the side wall away from the bottom board; and a second driving part, driving the lid to open or close with respect to the barrel-shaped body.

13. The storage device according to claim 12, wherein a side of the lid close to the bottom board is provided with a compression member, the compression member comprises a compression arm and a compression block connected with the compression arm, the compression arm is configured to stretch or compress along a central axis of the barrel-shaped body.

14. The storage device according to claim 12, further comprising:

a first distance measure sensor, disposed on an edge of an inner side of the side wall away from the bottom board or a side of the lid close to the bottom board, and configured to detect a first distance between an object in the storage bag and the side edge of the side wall away from the bottom board;

a prompt unit, disposed on the outer side of the side wall or a side of the lid away from the bottom board, and configured to send a warning signal upon the first distance being less than a preset value.

15. The storage device according to claim 12, further comprising:

a second distance measure sensor, disposed on outer side of the side wall or a side of the lid away from the bottom board, and configured to detect a second distance from a user outside the lid to the side wall or the lid.

16. A storage bag configured to automatically open and tighten when stored in a storage device, the storage bag comprises:

a storage bag body, and a first fixing element and a second fixing element respectively connected with two points on an edge of an opening of the storage bag body, the storage bag body is disposed between the first fixing element and the second fixing element, wherein the first fixing element and the second fixing element are C-shaped fixing elements having an approximate shape of C-shape, an inside diameter of the first fixing element is less than an inside diameter of the second fixing element, the first fixing element and the second fixing element are configured to move relative to each other to drive the two points on the edge of the opening of the storage bag body to move relative to each other.

17. The storage bag according to claim 16, wherein a length of the edge of the opening of the storage bag body between the two points respectively connected with the first fixing element and the second fixing element is less than one-third of an entire circumference of the opening of the storage bag body.

18. The storage bag according to claim 16, wherein, in a compression state, the storage bag body is located between the first fixing element and the second fixing element, and is compressed to be a cylinder with an approximately C-shaped section.

* * * * *